US011570554B2

(12) United States Patent
Gomez

(10) Patent No.: US 11,570,554 B2
(45) Date of Patent: Jan. 31, 2023

(54) HEARING AID SYSTEM INCLUDING AT LEAST ONE HEARING AID INSTRUMENT WORN ON A USER'S HEAD AND METHOD FOR OPERATING SUCH A HEARING AID SYSTEM

(71) Applicant: SIVANTOS PTE. LTD., Singapore (SG)

(72) Inventor: Gabriel Gomez, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 31 days.

(21) Appl. No.: 17/352,533

(22) Filed: Jun. 21, 2021

(65) Prior Publication Data

US 2021/0400399 A1 Dec. 23, 2021

(30) Foreign Application Priority Data

Jun. 18, 2020 (DE) ..... 10 2020 207 586.7

(51) Int. Cl.
*H04R 25/00* (2006.01)

(52) U.S. Cl.
CPC ..... *H04R 25/407* (2013.01); *H04R 25/505* (2013.01); *H04R 2225/55* (2013.01); *H04R 2225/61* (2013.01)

(58) Field of Classification Search
CPC ..... H04R 25/407; H04R 25/505; H04R 2225/55; H04R 2225/61; H04R 2430/20; H04R 25/40; H04R 25/43
See application file for complete search history.

(56) References Cited

U.S. PATENT DOCUMENTS

| | | | | |
|---|---|---|---|---|
| 6,754,358 | B1 * | 6/2004 | Boesen | H04M 1/6066 381/328 |
| 8,867,763 | B2 | 10/2014 | Bouse | |
| 11,134,348 | B2 * | 9/2021 | Mosgaard | H04R 25/554 |
| 2018/0007478 | A1 | 1/2018 | Nikles et al. | |
| 2019/0182606 | A1 * | 6/2019 | Petersen | A61B 5/291 |
| 2020/0260196 | A1 | 8/2020 | Kamkar-Parsi et al. | |

FOREIGN PATENT DOCUMENTS

| | | | |
|---|---|---|---|
| DE | 102012214081 | A1 | 12/2013 |
| DE | 102019201879 | B3 | 6/2020 |

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

A hearing aid system for assisting a user's ability to hear includes at least one hearing aid instrument worn on the user's head. A sound signal from the surroundings is recorded and converted into input audio signals by input transducers of the hearing aid system. The hearing aid system includes two adaptive beamformers with variable notch direction, applied indirectly or directly to the input audio signals to generate direction-dependently damped audio signals. The notch directions are set to mutually different values to minimize the energy content of the direction-dependently damped audio signal of each beamformer. The notch directions of the two beamformers are evaluated in comparative fashion. A user's head rotation is captured qualitatively and/or quantitatively if a correlated change in the notch directions is determined within the scope of the comparative evaluation. A method for operating the hearing aid system is also provided.

16 Claims, 3 Drawing Sheets

HEARING AID SYSTEM INCLUDING AT LEAST ONE HEARING AID INSTRUMENT WORN ON A USER'S HEAD AND METHOD FOR OPERATING SUCH A HEARING AID SYSTEM

CROSS-REFERENCE TO RELATED APPLICATION

This application claims the priority, under 35 U.S.C. § 119, of German Patent Application DE 10 2020 207 586.7, filed Jun. 18, 2020; the prior application is herewith incorporated by reference in its entirety.

BACKGROUND OF THE INVENTION

Field of the Invention

The invention relates to a hearing aid system for assisting a user's ability to hear, including at least one hearing aid instrument worn on the user's head, in particular in or on an ear. Further, the invention relates to a method for operating such a hearing aid system.

A hearing aid instrument generally refers to an electronic device which assists the ability of a person wearing the hearing aid instrument (who is referred to as "wearer" or "user" below) to hear. In particular, the invention relates to hearing aid instruments which are set up to fully or partly compensate a loss of hearing of a hearing-impaired user. Such a hearing aid instrument is also referred to as "hearing aid". Additionally, there are hearing aid instruments which protect or improve the ability of users with normal hearing to hear, for example which intend to facilitate an improved understanding of speech in complicated hearing situations.

Hearing aid instruments in general and specifically hearing aids are usually embodied to be worn on the head of the user and, in particular, in or on an ear in this case, in particular as behind-the-ear devices (BTE devices) or in-the-ear devices (ITE devices). In terms of their internal structure, hearing aid instruments regularly include at least one (acousto-electric) input transducer, a signal processing unit (signal processor), and an output transducer. During the operation of the hearing aid instrument, the input transducer or each input transducer records airborne sound from the surroundings of the hearing aid instruments and converts the airborne sound into an input audio signal (i.e., an electric signal which transports information about the ambient sound). This at least one input audio signal is also referred to below as "recorded sound signal". The input audio signal or each input audio signal is processed in the signal processing unit (i.e., modified in terms of its sound information) in order to assist the ability of the user to hear, in particular to compensate for a loss of hearing of the user. The signal processing unit outputs a correspondingly processed audio signal (also referred to as "output audio signal" or "modified sound signal") to the output transducer.

In most cases, the output transducer is embodied as an electro-acoustic transducer which converts the (electric) output audio signal back into airborne sound, wherein this airborne sound—which is being modified in relation to the ambient sound—is output into the auditory canal of the user. In the case of a hearing aid instrument worn behind the ear, the output transducer, which is also referred to as "receiver", is usually integrated in a housing of the hearing aid instrument outside of the ear. The sound output by the output transducer is guided into the auditory canal of the user by using a sound tube in this case. As an alternative thereto, the output transducer can also be disposed in the auditory canal, and consequently outside of the housing worn behind the ear. Such hearing aid instruments are also referred to as RIC devices (from "receiver in canal"). In-the-ear hearing aid instruments which are dimensioned to be so small that they do not protrude beyond the auditory canal to the outside are also referred to as CIC devices (from "completely in canal").

In further embodiments, the output transducer can also be formed as an electromechanical transducer which converts the output audio signal into structure-borne sound (vibrations), with this structure-borne sound being emitted to the cranial bone of the user, for example. Further, there are implantable hearing aid instruments, in particular cochlear implants, and hearing aid instruments whose output transducers directly stimulate the auditory nerve of the user.

The term "hearing aid system" denotes an individual device or a group of devices and possibly non-physical functional units, which together provide the functions required during the operation of a hearing aid instrument. In the simplest case, the hearing aid system can be formed of a single hearing aid instrument. As an alternative thereto, the hearing aid system can include two cooperating hearing aid instruments for supplying both ears of the user. In this case, reference is made to a "binaural hearing aid system". In addition, or as an alternative thereto, the hearing aid system can include at least one further electronic device, for example a remote control, a charger or a programming device for the hearing aid or each hearing aid. In the case of modern hearing aid systems, a control program, in particular in the form of a so-called app, is often provided instead of a remote control or a dedicated programming device, with this control problem being embodied for implementation on an external computer, in particular a smartphone or tablet. In this case, the external computer itself is regularly not part of the hearing aid system, inasmuch as, as a rule, it is provided independently of the hearing aid system and not by the manufacturer of the hearing aid system either.

In order to damp noise during the operation of a hearing aid system, and hence, in particular, to improve the understanding of speech within the scope of communication between the user and another speaker, direction-dependent damping (beamforming) of the input audio signal is often used within the scope of signal processing in a hearing aid system. In modern hearing aid systems, corresponding damping units (beamformers) sometimes have an adaptive embodiment. Such an adaptive beamformer can regularly variably align a direction of maximum damping (notch) with a certain source of noise in order to particularly effectively damp the sound component emanating from this source of noise. However, when the user rotates their head, the notch of an adaptive beamformer should be adjusted counter to the direction of the head rotation in such a way that the beamformer remains aligned with the source of noise to be damped, both during and following the rotation of the head. Otherwise, the direction-dependent damping during a head rotation leads to a modulation of the modified sound signal output by the hearing aid system to the user, which can sometimes quite severely impair the hearing impression of the user and, in extreme cases, can even cause a deterioration in the understanding of speech (in place of the desired improvement).

In order to avoid such negative effects, an adaptive beamformer is frequently realized with a sufficiently high adaptation speed in such a way that it can independently realign without a noticeable time offset in the case of a head rotation. However, such quickly adapting beamformers disadvantageously tend to have instability in the case of dynamic hearing situations. In particular, the notch of such a beamformer sometimes jumps between different sources of noise, which, in turn, can severely impair the hearing perception of the user. Another approach resides in detecting the rotation of the head and, in this case, adapting the beamformer according to needs.

In order to detect head rotation, modern hearing aid instruments are frequently provided with an accelerometer, a gyroscope or an electronic compass. However, the integration of such a sensor disadvantageously increases the technical complexity, and hence also the manufacturing outlay, of a hearing aid instrument and may be difficult or even impossible in the case of small hearing aid instruments, in particular.

BRIEF SUMMARY OF THE INVENTION

It is accordingly an object of the invention to provide a hearing aid system including at least one hearing aid instrument worn on a user's head and a method for operating such a hearing aid system, which overcome the hereinaforementioned disadvantages of the heretofore-known systems and methods of this general type and which facilitate a detection of a head rotation in a space-saving and comparatively uncomplicated fashion during the operation of the hearing aid system.

With the foregoing and other objects in view there is provided, in accordance with the invention, a hearing aid system and a method for operating a hearing aid system for assisting a user's ability to hear, as described below. Advantageous configurations and developments of the invention, some of which are inventive on their own, are presented in the dependent claims and the following description.

Generally, the invention proceeds from a hearing aid system for assisting a user with the ability to hear, wherein the hearing aid system includes at least one hearing aid instrument that is worn on the user's head, in particular in or on an ear. As described above, the hearing aid system can be formed exclusively of a single hearing aid instrument in simple embodiments of the invention. In another embodiment of the invention, the hearing aid system includes at least one further component in addition to the hearing aid instrument, for example a further hearing aid instrument (in particular an equivalent hearing aid instrument) for caring for the other ear of the user, a control program (in particular in the form of an app) to be carried out on an external computer (in particular a smartphone) of the user and/or at least one further electronic device, for example a remote control or a charger. In this case, the hearing aid instrument and the at least one further component exchange data, with the functions of data storage and/or data processing of the hearing aid system being split among the hearing aid instrument and the at least one further component.

The hearing aid system includes at least two input transducers which serve to record one sound signal (in particular in the form of airborne sound) each from the surroundings of the hearing aid instrument. The at least two input transducers can be disposed in the same hearing aid instrument, particularly if the hearing aid system includes only a single hearing aid instrument. In the case of a binaural hearing aid system with two hearing aid instruments, the at least two input transducers can alternatively also be distributed among the two hearing aid instruments.

Expediently, the hearing aid system furthermore includes a signal processing unit for processing (modifying) the recorded sound signal in order to assist the ability of the user to hear, and an output transducer for outputting the modified sound signal. In the case of a binaural hearing aid system, both hearing aid instruments preferably have a signal processing unit and an output transducer each. Instead of a second hearing aid instrument with input transducer, signal processing unit and output transducer, the hearing aid system within the scope of the invention can, however, also include a hearing aid instrument for the second ear without its own output transducer; instead, this hearing aid instrument for the second ear only records sound and transmits the latter—with or without signal processing—to the hearing aid instrument of the first ear. Such so-called CROS or BiCROS instruments are used for users with deafness on one side, in particular. Further, the signal processing or part of same can also be outsourced from the hearing aid instrument or the hearing aid instruments to an external unit, e.g., an app running on a smartphone, within the scope of the invention.

The hearing aid instrument or each hearing aid instrument of the hearing aid system is available, in particular, in one of the configurations described at the outset (BTE device with internal or external output transducer, ITE device, e.g., CIC device, hearing implant, in particular cochlear implant, hearable, etc.). In the case of a binaural hearing aid system, both hearing aid instruments preferably have an embodiment of the same kind.

Each of the input transducers is, in particular, an acousto-electric transducer which converts airborne sound from the surroundings into an electric input audio signal. The output transducer or each output transducer is optionally preferably embodied as an electro-acoustic transducer (receiver), which converts the audio signal modified by the signal processing unit back into an airborne sound. Alternatively, the output transducer is embodied to output a structure-borne sound or for directly stimulating the auditory nerve of the user.

According to the invention, multiple, direction-dependent damping of the input audio signals (or of internal audio signals derived from preprocessing the input audio signals) is used by using at least two adaptive beamformers in order to analyze the hearing situation (in particular the relative position of dominant sources of noise relative to the head of the user) and thus identify a rotation of the head of the user. Within the scope of the method, a sound signal is recorded from the user's surroundings and converted into input audio signal by using the at least two input transducers of the hearing aid system. The input audio signals are fed directly (i.e., in unprocessed form) or indirectly (i.e., in already pre-processed form) to a first adaptive beamformer with a variable first notch direction and a second beamformer with a second variable notch direction.

The first adaptive beamformer is applied (indirectly or directly) to the input audio signals in order to generate a first direction-dependently damped audio signal. In this case, the first notch direction is set in such a way that the energy content of the first direction-dependently damped audio signal is minimized. Likewise, the second adaptive beamformer is also applied (indirectly or directly) to the input audio signals in order to generate a second direction-dependently damped audio signal. The second notch direction is likewise set in such a way that the energy content of the second direction-dependently damped audio signal is minimized. In this case, the two adaptive beamformers are coupled so that the second notch direction can only assume a value that differs from the first notch direction. This prevents the two adaptive beamformers from aligning with the same source of noise.

In an expedient embodiment of the invention, the notch directions are defined in the form of angle specifications, for example relative to the viewing direction of the user. Alternatively, the notch directions can also be specified as abstracted variables—which are correlated with the alignment of the notch in linear or nonlinear fashion—for example in the form of a weighting factor used to weight different basic directional signals (e.g., a cardioid signal and an anti-cardioid signal, etc.) for the purposes of setting conventional adaptive beamformers, or in the form of a variable time delay with which different signal components are superposed on one another for the purposes of generating the directional effect.

In order to capture a head rotation, the first notch direction and the second notch direction are evaluated in comparative fashion. In the process, the user's head rotation is captured qualitatively and/or quantitatively if a correlated change in the first notch direction and in the second notch direction is determined within the scope of the comparative evaluation.

The method is based on the discovery that all static sources of noise in the surroundings of the user appear to rotate about the head in synchronous fashion and in the same way—as seen relative to the head and hence from the position of the at least one hearing aid instrument—in the case of a head rotation, while such a correlated rotation of sources of noise is very unlikely in the case of a stationary head. By virtue of the notch directions of different beamformers aligned with different sources of noise being compared with one another in respect of the correlation of the changes of the notch directions, changes that can be traced back to a head rotation are effectively differentiated from changes that are caused by an actual movement of sources of noise. Head rotations are identified as a result of this. Advantageously, the method can be carried out by using the device for signal processing (in particular a signal processor) that are present in a hearing aid system in any case. In particular, the adaptive beamformers described above can be (and preferably are) realized by software running in a signal processor of the hearing aid system. In this case, dedicated hardware is not required to carry out the method and is preferably not provided either. However, an acceleration, movement or direction sensor is not required for the head rotation detection according to the invention and therefore preferably not provided either within the scope of the hearing aid system. Therefore, the method according to the invention can be implemented with comparatively little outlay within the scope of the mass production of hearing aid systems and can also be used without problems in very small hearing aid instruments.

However, the method according to the invention can also be used in hearing aid systems in which a head rotation detection is implemented in conventional fashion by using an acceleration, movement or direction sensor. In this case, the method according to the invention is advantageous for redundantly determining the head rotation and consequently avoiding or correcting possible detection errors of the sensor-based head rotation detection.

As a sign for a correlated change in the notch directions of the two adaptive beamformers, a corresponding duration and/or corresponding start and end times of the change, in particular, are recognized. Additionally, or alternatively, a corresponding rotary angle interval and/or a corresponding rate of rotation of the notch directions are/is identified as a sign for a correlated change. Further additionally or in yet a further alternative thereto, a correlated change in the notch directions is recognized by forming the mathematical cross-correlation function.

In principle, it is possible that the head rotation is only captured qualitatively in simple embodiments of the invention. Thus, this case only captures that the head is rotated but not how the head is rotated. To this end, a notification signal indicating the head rotation (e.g., in the form of a so-called flag, i.e., a one bit signal) is generated for example when and while head rotation is recognized. In addition, or as an alternative thereto, the head rotation is captured qualitatively by capturing (and possibly storing) and assigned time.

In addition, or as an alternative to the qualitative capture, the head rotation is however (possibly also) captured quantitatively in preferred embodiments of the invention. Thus, in this case it is (possibly also) the manner and/or the extent of the head rotation that are/is captured. To this end, at least one measured variable is preferably captured, the latter being characteristic for the rate of rotation (angular speed), a rotary angle interval, a duration of the head rotation (and additionally or alternatively a start and end time of the head rotation) and/or a time-dependent orientation of the head in the surrounding space. This measured variable can be the rate of rotation (angular speed), the rotary angle interval, the duration of the head rotation (or the start and end time of the head rotation) and/or the time-dependent orientation of the head itself. However, the measured variable can for example also be an abstract variable, for example the rate of change, the change interval or start and end times of the change of the above-described weighting factor or of the above-described time delay. Within the scope of the invention, the head rotation can alternatively be captured as a one-dimensional rotation of the head about the vertical axis or—in refined variants of the method—as a two or three-dimensional rotation of the head in space.

In order to avoid detection errors (in particular a misinterpretation of moving sources of noise as an indication of a head rotation), at least one further (i.e., i-th where i=3, 4, 5, . . . ) adaptive beamformer with a variable further (i-th where i=3, 4, 5, . . . ) notch direction is additionally applied in a preferred embodiment of the method indirectly or directly to the input audio signals in addition to the first and the second adaptive beamformer in order to generate a further (i-th where i=3, 4, 5, . . . ) direction-dependently damped audio signal. Like the second adaptive beamformer before, the further or each further (i-th) beamformer is also coupled to the other beamformers in such a way that every beamformer must adjust to a different source of noise. Therefore, the further (i-th) notch direction—which is defined as an angle specification or abstracted variable just like the first and second notch direction—is also set to a value that differs from that of the notch directions of the other beamformers so that the energy content of the further (i-th) direction-dependently damped audio signal is minimized. In addition to the first and the second notch direction, the at least one further (i-th) notch direction is also included in the comparative evaluation. In this case, a head rotation by the user is qualitatively and/or quantitatively captured as described above if, within the scope of the comparative evaluation, a correlated change of at least two of the notch directions is determined. Preferably, the number of beamformers is dynamically adapted during the operation of the hearing aid system to the number of sources of noise (at least the dominant sources of noise, i.e., those sources of noise that supply a significant contribution to the ambient sound).

In this case, the correlated change of at least two of the notch directions is a necessary but not necessarily sufficient condition for recognizing the head rotation. Thus, in refined variants of the invention, the comparative evaluation of the notch directions can be complemented by at least one additional condition in order to further reduce the risk of detection errors.

Such further conditions in particular consider the case that in simple hearing situations at least one of the coupled beamformers no longer finds a dominant sound source with which it could align under given circumstances. The notch direction of such a beamformer regularly shows—due to lack of an alignment with a dominant source of noise—an unstable time behavior (and consequently wanders pseudo-randomly in space) which might cause a random correlation with the notch direction of another beamformer which is aligned with a moving source of noise and might consequently cause a detection error in inexpedient circumstances.

In order to preclude such detection errors, unstable notch directions are identified and excluded from the comparative evaluation, or at least taken into account with a lower weighting, in advantageous embodiments of the method.

To this end, at least one of the notch directions is preferably taken into account in the comparative evaluation with a different (binary or continuous) weighting on the basis of the magnitude of the energy minimization obtained by the variation of this notch direction—and consequently on the basis of the magnitude of the sound source with which the associated beamformer is aligned. In this case, beamformers which do not find a pronounced energy minimum are taken into account less or not at all in the comparative evaluation.

In addition, or as an alternative thereto, at least one of the notch directions is taken into account with a different (binary a continuous) weighting in the comparative evaluation on the basis of the time stability of this notch direction. Notch directions which have varied comparatively significantly in a preceding time interval are taken into account less or not at all in this case. By way of example, the time stability of the notch direction is ascertained by capturing the standard deviation and/or the mean crossing rate of the notch direction for a specified earlier period of time. The mean crossing rate denotes the rate with which the current notch direction shoots over and under a sliding temporal mean of the notch direction. Further additionally or in yet a further alternative thereto, the number of sign changes of the first time derivative of the notch direction is used as a measure for the time stability of the notch direction.

In an expedient embodiment the hearing aid system includes as a functional constituent part of the signal processing a signal processing unit, which is fed with the input audio signals directly or indirectly through a pre-processing stage and in which these audio signals are modified by using a number of signal processing processes (i.e., at least one signal processing process but preferably a plurality of signal processing processes) on the basis of a number of adjustable signal processing parameters (i.e., at least one signal processing parameter but preferably a plurality of signal processing parameters) in order to be output to the user by using an output transducer of the hearing aid instrument. In this case, at least one signal processing parameter is preferably set depending on the qualitative and/or quantitative capture of the head rotation.

The signal processing unit preferably includes at least one adaptive signal processing process, for example for direction-dependent damping (adaptive beamforming), for feedback suppression (adaptive feedback cancellation), for active noise suppression (active noise canceling), etc., through the use of which the input audio signals or an intermediate signal processed therefrom by pre-processing are/is modified on the basis of an adjustable adaptation speed. In this case, the adaptation speed is preferably set depending on the qualitative and/or quantitative capture of the head rotation. By way of example, the adaptation speed is increased if and for as long as a head rotation is determined by using the method according to the invention.

In addition or as an alternative thereto, the capture of the head rotation according to the method can also be used for different purposes, for example for documentation purposes (data logging), for capturing operating commands of the user in order to allow the user to control the hearing aid system by gestures (specifically by targeted head movements), or for assessing the physiological or psychological state of the user (for example, physiological disorders such as, e.g., vertigo or psychological impairments can be deduced by the recording and statistical evaluation of the head movement of the user).

Within the scope of the invention, at least one of the adaptive beamformers used according to the method for the purposes of capturing the head rotation can be a constituent part of the signal processing unit. In this case, the direction-dependently damped signal generated by this beamformer is also output to the user—optionally in further-processed form and/or in combination with other signal components—as a modified audio signal or as part of same.

However, in a preferred embodiment of the invention, the adaptive beamformers used to capture the head rotation are only used to analyze the hearing situation. In this case, the adaptive beamformers are part of a signal analysis unit that is separate from the signal processing unit. The direction-dependently damped signal generated by the beamformers in each case is used in this case only to determine the energy optimization, and consequently to set the notch direction, in particular.

In order to recognize the head rotation within the scope of the invention, use is preferably made of beamformers which, firstly, adapt sufficiently quickly in order to be able to follow a usual head rotation in real time. Secondly, the beamformers are preferably prevented from jumping back and forth between different sources of noise in dynamic hearing situations. To this end, the adaptation speed of the beamformers is varied depending on the magnitude of the energy minimization in an advantageous method variant. For as long as a certain beamformer is aligned with an active source of noise and consequently the energy minimization for the notch direction set is sufficiently large (which is identified by virtue of the fact that, for example, the ratio of the energy content of the direction-dependently damped audio signal to the energy content of the audio signals fed to the beamformer is below a specified limit), the adaptation speed for this beamformer is set to a comparatively high value. The limit is preferably varied on the basis of the type of acoustic scene. In the case of a diffuse sound field, the limit is, e.g., chosen to be smaller than in quiet surroundings with few sources of sound since experience shows that the damping effect of the beamformer is less in the former case than in the latter case. By way of example, the adaptation speed is set in such a way that a change in the notch direction of up to 180° per second is facilitated. Otherwise, particularly if the source of noise with which the beamformer is aligned has temporarily become inactive and hence the magnitude of the energy minimization reduces, in particular drops below the limit, the adaptation speed is reduced. By way of example, the admissible rate of change of the notch direction is restricted to ±2° per second in this case. What this reduction in the adaptation speed achieves is that the beamformers maintain their alignment with a certain source of noise, even if this source of noise is briefly inactive.

When a head rotation is identified by using the method, the notch direction of the beamformer or each beamformer aligned with a currently inactive source of noise is preferably further also updated with the correlated changes of the notch directions of the other beamformers aligned with active sources of noise. What this achieves is that, in the case of an identified head rotation, the updated notch direction remains aligned with the associated source of noise even in the case of temporary inactivity of the latter in such a way that this beamformer is able to immediately be used again for the head rotation detection as soon as the source of noise becomes active again.

In general, the hearing aid system according to the invention is set up to automatically carry out the above-described method according to the invention. To this end, the hearing aid system includes the first and second adaptive beamformer (as described above). The hearing aid system furthermore includes an evaluation unit which is set up to evaluate the first notch direction and the second notch direction in comparative fashion and to qualitatively and/or quantitatively capture a user's head rotation when the evaluation unit determines a correlated change in the first notch direction and the second notch direction within the scope of the comparative evaluation.

The hearing aid system is set up in terms of programming and/or circuitry in order to automatically carry out the method according to the invention. Thus, the hearing aid system according to the invention includes a programming device (software) and/or circuitry device (hardware, e.g., in the form of an ASIC), which automatically carry out the method according to the invention during the operation of the hearing aid system. The programming and/or circuitry device for carrying out the method, in particular the beamformers and the evaluation unit, can be disposed exclusively in the hearing aid instrument (or the hearing aid instruments) of the hearing aid system in this case. Alternatively, the programming and/or circuitry device for carrying out the method are distributed among the hearing aid instrument or the hearing aids and at least one further device or a software component of the hearing aid system. By way of example, the programming device for carrying out the method are distributed among the at least one hearing aid instrument of the hearing aid system and a control program installed on an external electronic device (in particular a smartphone). As a rule, the external electronic device is itself not part of the hearing aid system in this case, as mentioned above.

The above-described embodiments of the method according to the invention correspond to corresponding embodiments of the hearing aid system according to the invention. The explanations given above in relation to the method according to the invention are accordingly transferable to the hearing aid system according to the invention, and vice versa.

In preferred embodiments of the invention, the evaluation unit is set up, in particular, to generate a notification signal (e.g., set a flag) indicating the head rotation and/or to capture the time of the head rotation for the qualitative capture of the head rotation and/or to capture a measured variable characteristic for a rate of rotation (angular speed), a rotary angle interval, a duration of the head rotation and/or an orientation of the head in the surrounding space for the quantitative capture of the head rotation.

Preferably, the hearing aid system includes at least one further (i-th) adaptive beamformer (as described above) in addition to the first and second beamformer. In this case, the evaluation unit is set up to evaluate the first notch direction, the second notch direction and the at least one further notch direction in comparative fashion and to capture a user's head rotation qualitatively and/or quantitatively when a correlated change in at least two of the notch directions is determined within the scope of the comparative evaluation.

Furthermore, the evaluation unit is preferably set up to take into account at least one of the notch directions with a different (binary or continuous)

weighting in the comparative evaluation, depending on the magnitude of the energy minimization obtained, by the variation in this notch direction and/or, depending on the time stability of this notch direction.

The at least one hearing aid instrument expediently includes a signal processing unit, to which the input audio signals are fed directly or indirectly through a pre-processing unit and in which these audio signals are processed by using a number of signal processing processes, depending on a number of adjustable signal processing parameters, in order to be output to the user by using an output transducer of the hearing aid instrument. In this case, the hearing aid system preferably includes a device (e.g., the evaluation unit or a parameterization unit separate therefrom) for setting at least one signal processing parameter depending on the qualitative and/or quantitative capture of the head rotation.

The signal processing unit preferably includes at least one adaptive signal processing process (as described above), which is parameterized by an adjustable adaptation speed. The hearing aid system preferably includes a device (once again, e.g., the evaluation unit or a parameterization unit separate therefrom) for setting this adaptation speed depending on the qualitative and/or quantitative capture of the head rotation.

Other features which are considered as characteristic for the invention are set forth in the appended claims.

Although the invention is illustrated and described herein as embodied in a hearing aid system including at least one hearing aid instrument worn on a user's head and a method for operating such a hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
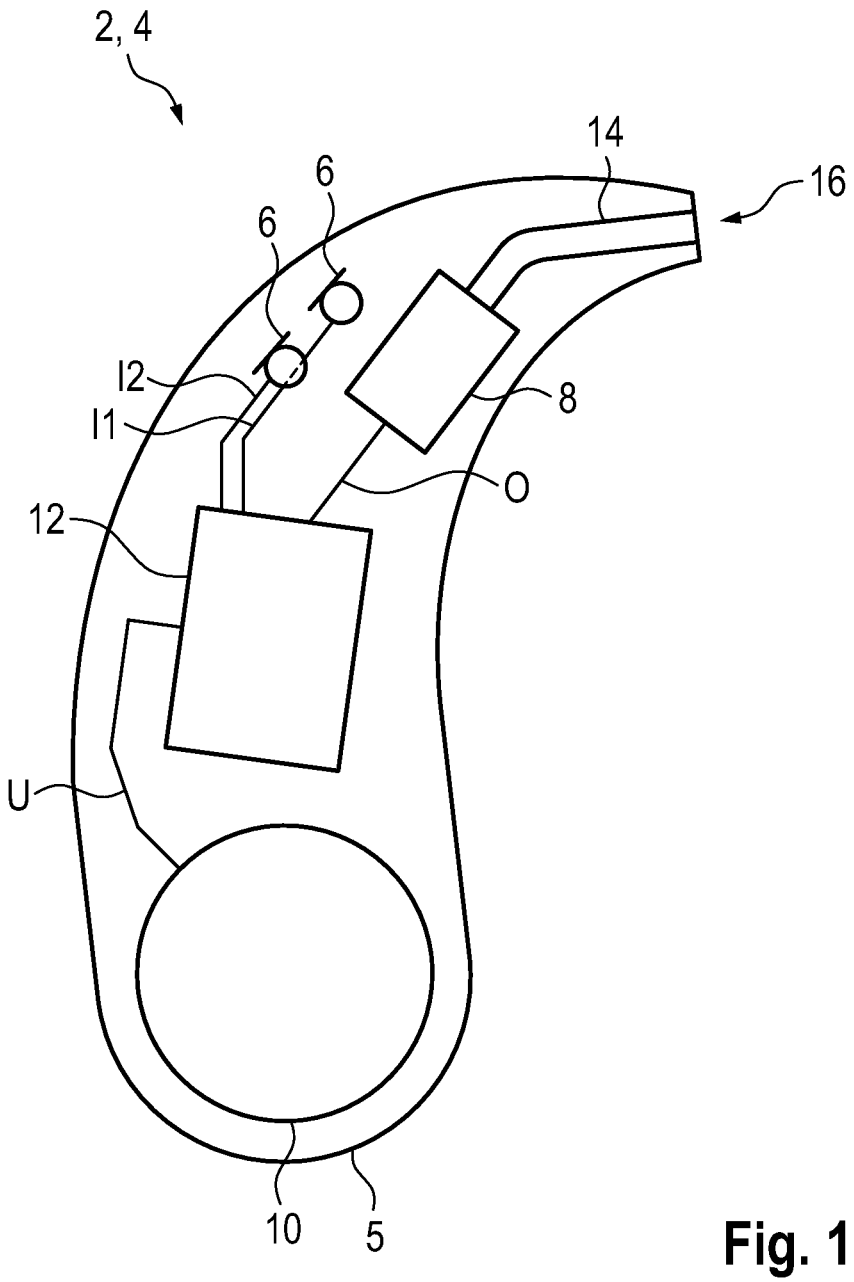
FIG. 1 is a diagrammatic, plan view of a hearing aid system formed of a single hearing aid instrument and being in the form of a hearing aid that is wearable behind an ear of a user.

Referring now in detail to the figures of the drawings, in which parts and variables corresponding to one another are always provided with the same reference signs, and first, particularly, to FIG. 1 thereof, there is seen a hearing aid system 2 which is formed in this case of a single hearing aid 4, i.e., a hearing aid instrument configured to assist the ability of a hearing-impaired user to hear. In the example illustrated herein, the hearing aid 4 is a BTE hearing aid, which is able to be worn behind an ear of a user.

Optionally, in a further embodiment of the invention, the hearing aid system 2 includes a second hearing aid, not expressly illustrated, which serves to supply the second ear of the user and which, in particular, corresponds in terms of its setup to the hearing aid 4 illustrated in FIG. 1.

Within a housing 5, the hearing aid 4 includes two microphones 6 as input transducers and a receiver 8 as an output transducer. The hearing aid 4 furthermore includes a battery 10 and signal processing in the form of a signal processor 12. Preferably, the signal processor 12 includes both a programmable subunit (e.g., a microprocessor) and a non-programmable subunit (e.g., an ASIC).

The signal processor 12 is fed with a supply voltage U from the battery 10.

During normal operation of the hearing aid 4, the microphones 6 each record airborne sound from the surroundings of the hearing aid 4. The microphones 6 each convert the sound into an (input) audio signal I1 and I2, respectively, which contains information about the recorded sound. Within the hearing aid 4, the input audio signals I1, I2 are fed to the signal processor 12, which modifies these input audio signals I1, I2 to assist the ability of the user to hear.

The signal processor 12 outputs an output audio signal O, which contains information about the processed and hence modified sound, to the receiver 8.

The receiver 8 converts the output audio signal O into a modified airborne sound. This modified airborne sound is transferred into the auditory canal of the user through a sound channel 14, which connects the receiver 8 to a tip 16 of the housing 5, and through a flexible sound tube (not explicitly shown), which connects the tip 16 with an earpiece inserted into the auditory canal of the user.

Figure 2:
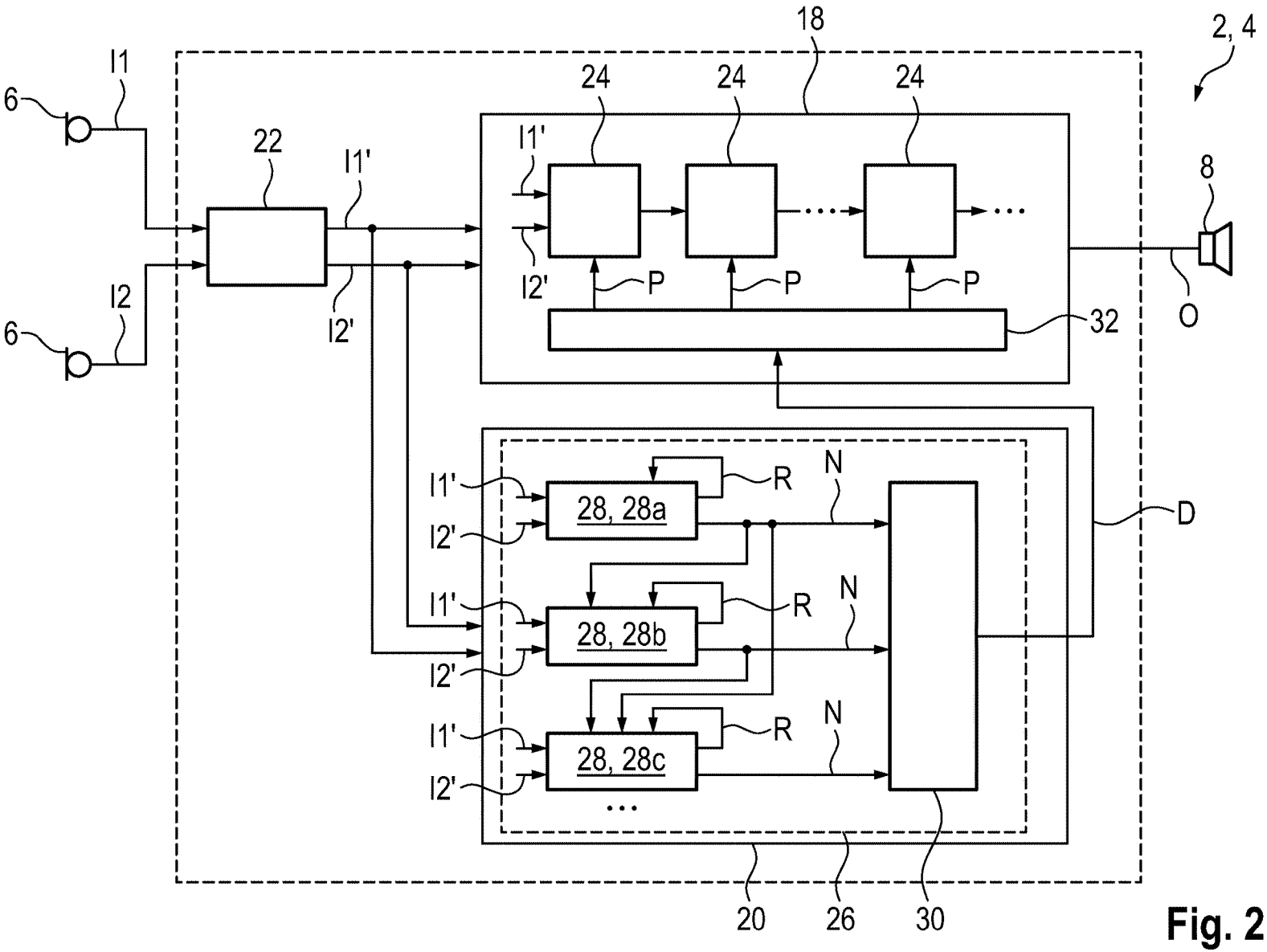
FIG. 2 is a schematic and block diagram of the structure of signal processing of the hearing aid instrument of FIG. 1.

The structure of the signal processing is illustrated in more detail in FIG. 2. From this, it is evident that the signal processing of the hearing aid system 2 is organized in two functional constituent parts, specifically a signal processing unit 18 and a signal analysis unit 20. The signal processing unit 18 serves to generate the output audio signal O from the input audio signals I1, I2 of the microphones 6 or, therefrom, from internal audio signals I1', I2' derived from pre-processing. In the case mentioned first, the input audio signals I1, I2 of the microphones 6 are directly fed to the signal processing unit 18. In the latter case, illustrated in FIG. 2 in exemplary fashion, the input audio signals I1, I2 of the microphones 6 are initially fed to a pre-processing unit 22, which then derives the internal audio signals I1', I2' therefrom and supplies these to the signal processing unit 18.

In the pre-processing unit 22, the input audio signals I1, I2 are preferably superposed on one another with a time offset to form the internal audio signals I1', I2', in such a way that the two internal audio signals I1', I2' correspond to a cardioid signal or an anti-cardioid signal.

The signal processing unit 18 includes a number of signal processing processes 24, which successively process the input audio signals I or—in the example as per FIG. 2—the internal audio signals I1', I2' and modify these in the process in order to generate the output audio signal O and hence compensate the loss of hearing of the user.

By way of example, the signal processing processes 24 include:

a process for suppressing noise and/or feedback, a process for dynamic compression and a process for frequency-dependent amplification on the basis of audiogram data, etc.

In this case, at least one signal processing parameter P is assigned in each case to at least one of these signal processing processes 24 (as a rule, to all signal processing processes 24 or at least to most signal processing processes 24). The signal processing process 24 or each signal processing process 24 is a one-dimensional variable (binary variable, natural number, floating-point number, etc.) or a multi-dimensional variable (array, function, etc.), the value of which parameterizes (i.e., influences) the functionality of the respectively assigned signal application process 24. In this case, signal processing parameters P can activate or deactivate the respectively assigned signal processing process 24, can continuously or incrementally amplify or weaken the effect of the respectively assigned signal processing process 24, can define time constants for the respective signal processing process 24, etc.

By way of example, the signal processing parameters P include:

gain factors for a process for frequency-dependent amplification, a characteristic for a process for dynamic compression, a control variable for continuously setting the strength of a process for noise and/or feedback suppression, etc.

Furthermore, at least one of the signal processing processes 24 preferably is an adaptive process, the adaptation speed of which can be variably set by using one of the signal processing parameters P. By way of example, the signal processing processes 24 include an adaptive "beamformer" with variable adaptation speed, which is set up to direction-dependently damp the input audio signals I1, I2 (or the internal audio signals I1', I2' derived therefrom) in order to generate the output audio signal O.

By way of example, the signal processing processes 24 are implemented partly in the form of (non-programmable) hardware circuits and, in another part, in the form of software modules (in particular firmware) in the signal processor 12.

The signal analysis unit 20 includes—preferably in addition to other functions, not illustrated explicitly in this case, for analyzing sound, such as, e.g., a classifier for analyzing hearing situations—a head rotation detection unit 26, which is preferably implemented in the signal processor 12 in the form of software. The head rotation detection unit 26 includes a plurality of beamformers 28 with the same structure, i.e., processes for direction-dependent damping, which are each fed with the input signals I1, I2 or—as illustrated in the example as per FIG. 2—the internal audio signals I1', I2' derived therefrom and which each output a direction-dependently damped audio signal R. Each beamformer 28 generates the associated direction-dependently damped signal R by virtue of superposing the two fed audio signals I1', I2' (i.e., a cardioid signal and an anti-cardioid signal in the example as per FIG. 2), which are weighted by using a weighting factor a:

$$R = I1' - a \cdot I2' \text{ where } a = [-1;1] \qquad \text{Eq. 1}$$

In this case, the weighting factor a determines the value of a notch direction N which—as is seen relative to the head of the user—indicates the direction in which the respective beamformer 28 maximally damps the fed audio signals I1', I2'. In this case, the weighting factor a and the notch direction are uniquely correlated with one another by way of a nonlinear mathematical function (N=N(a)) and can consequently be converted into one another.

The beamformers 28 (three beamformers 28*a*, 28*b* and 28*c* in the example according to per FIG. 2) each have an adaptive embodiment. In this case, each beamformer 28 is set up to automatically set the weighting factor a (and hence the notch direction N) in such a way that the energy content of the direction-dependently damped audio signal R output thereby is minimized. Consequently, the direction-dependently damped audio signal R is a function of the weighting factor a (R=R(a)) or, equivalently, a function of the notch direction N (R=R(N)).

To this end, the direction-dependently damped signal R output by each beamformer 28 is returned thereto. As a measure for the energy minimization, and hence for setting the weighting factor a (and consequently the notch direction N), each beamformer 28 for example determines the ratio of the squared levels of the direction-dependently damped audio signal R and of the internal audio signals I1', I2'

$$E_R = \frac{|R(a)|^2}{0.5 \cdot (|I1'|^2 + |I2'|^2)} \quad \text{Eq. 2}$$

and minimizes, for example using Newton's method, this variable while varying the weighting factor a. As an alternative to Newton's method, use is made, for example, of the conjugate gradient method (CG method).

In the example as per FIG. 2, the beamformers 28 only serve to analyze the input audio signals I1, I2 or the internal audio signals I1', I2'. Therefore, the direction-dependently damped audio signals R of these beamformers 28 are not output by the receiver 8 or processed further for an output.

From the weighting factor a, each beamformer 28 calculates the associated notch direction N and outputs this notch direction N to a downstream evaluation unit 30. Moreover, each beamformer 28 also outputs the notch direction N set thereby to a possibly subordinate beamformer 28. Thus, the beamformer 28*a* as per FIG. 2 outputs the notch direction N set thereby to the beamformers 28*b* and 28*c* while the beamformer 28*b* outputs the notch direction N set thereby to the beamformer 28*c*. In this case, each beamformer 28 is set up to leave out the notch directions N of the superordinate beamformers 28 fed thereto (in each case observing a distance interval of, e.g., ±5°) when setting its own notch direction N. Consequently, the beamformers 28*a*, 28*b*, 28*c* form a cascade of coupled beamformers 28, in which each beamformer 28 necessarily sets a different notch direction N and consequently aligns with a different source of noise.

The evaluation unit 30 compares the time profile of the fed notch directions N to one another. As soon as the evaluation unit 30 determines a correlated change of at least two of the fed notch directions N, the evaluation unit 30 identifies this as an indication of the user having moved their head. In this case, the evaluation unit 30 generates a notification signal D indicating the head rotation and feeds this notification signal D to the signal processing unit 18.

Within the signal processing unit 18, the notification signal D is supplied to a parameterization unit 32, which provides the signal processing parameters P for the signal processing processes 24. In this case, the parameterization unit 32 provides at least one of the signal processing parameters P with a value that varies depending on the notification signal D. Consequently, the parameterization unit 32 controls at least one of the signal processing processes 24 differently when the head rotation detection unit 26 identifies a head rotation than in the periods of time during which the head rotation detection unit 26 does not detect a head rotation. Provided the signal processing processes 24 include an adaptive process, in particular an adaptive beamformer, with a variable adaptation speed, this adaptation speed is preferably varied by the parameterization unit 32 on the basis of the indication signal D. In particular, the parameterization unit 32 increases the adaptation speed during and just after the head rotation in such a way that the adaptive process can quickly adapt to the change in the hearing situation caused by the head rotation. During periods of time in which the head rotation detection unit 26 does not detect a head rotation, the adaptation speed is by contrast reduced to a comparatively low value by the parameterization unit 32. Consequently, in the absence of a head rotation, the adaptive signal processing process is set with comparatively high inertia in order to ensure stable signal processing. In addition, or as an alternative to the increase in the adaptation speed, the parameterization unit 32 temporarily reduces the strength of the directional effect (in particular the notch depth) during and just after the identified head rotation, which avoids some artifacts of the signal processing and facilitates a better orientation of the hearing aid wearer.

In order to determine correlated changes of at least two of the fed notch directions N, the evaluation unit 30 forms, in each case in pairwise fashion, the cross-correlation function between the fed notch directions N. In this case, the evaluation unit 30 identifies the presence of a head rotation if the value of at least one of the cross-correlation functions formed exceeds a given threshold.

In an alternative embodiment, the evaluation unit 30 in each case captures the start and end times of changes and the respective change amplitude (i.e., the value by which the respective notch direction N has changed) for each of the fed notch directions N. In this case, it identifies the presence of a head rotation if at least two of the fed notch directions N each have a change with (within specified tolerance ranges) the same start and end times and the same change amplitude.

In yet a further alternative, the evaluation unit 30 captures the sign and/or the magnitude of the temporal change (in particular the sign of the first time derivative) for each of the fed notch directions N. In this case, it identifies the presence of a head rotation if a sufficiently large number of the determined signs are equal (thus, for example, if all notch directions N, optionally apart from the notch direction N of a beamformer 28 adapted to the user's own voice, change in the same direction) or if a plurality of notch directions N experience a change of equal magnitude.

However, in both cases, the evaluation unit 30 generates the notification signal D upon identification of a head rotation only once the change in the correlated notch directions N exceeds a specified threshold, for example 10° (i.e., if the correlated notch directions N have changed by more than the specified threshold).

In a simple embodiment of the hearing aid system 2, the notification signal D is a variable which only provides qualitative notification of the identified head rotation without characterizing this head rotation in any more detail. By way of example, the evaluation unit 30 places a flag, as soon as and for as long as it identifies a head rotation, as a notification signal D.

However, in addition or as an alternative to the purely qualitative indication for the head rotation, the notification signal D preferably contains at least one specification which qualitatively characterizes the identified head rotation, in particular a specification relating to the rotary angle through which the head is rotated and/or relating to the rate of rotation (i.e., the angular speed) of the head rotation.

In order to ensure that each beamformer 28 can adapt its notch direction R in real time in the case of a head rotation but, at the same time, to avoid the notch direction N jumping back and forth between different sources of noise, each beamformer 28 is preferably set up to vary its adaptation speed depending on the magnitude of the energy minimization, in particular depending on the value of the variable ER as per Eq. 2. For as long as a certain beamformer 28 is aligned with an active source of noise and consequently the energy minimization for the set notch direction N is sufficiently large (for example, if and for as long as the variable ER is below a given limit), this beamformer 28 sets its adaptation speed to a comparatively high value in such a way that, for example, a rate of change of the notch direction N of up to 180° per second is facilitated. Otherwise, i.e., if it is temporarily not possible to obtain a significant energy minimization by varying the weighting factor a (and hence the notch direction N), the beamformer 28, or each affected beamformer 28, reduces its adaptation speed in such a way that, for example, the admissible rate of change of the notch direction is restricted to ±2° per second. What this reduction in the adaptation speed achieves is that the beamformers 28 maintain their alignment with a certain source of noise, even if this source of noise is briefly inactive.

Beamformers 28 which, as described above, do not attain any significant energy minimization (for example, because they are not yet or no longer aligned with a dominant source of noise or because their associated source of nose has briefly become inactive) are referred to as "searching" below in order to simplify the language.

In order to prevent such a searching beamformer 28 from disturbing the comparative evaluation of the notch directions N undertaken by the evaluation unit 30, the beamformers 28 are preferably set up to output the set notch direction N to the evaluation unit 30 and the downstream beamformers 28 only if and only after they have aligned with an active, dominant source of noise and are consequently no longer searching.

In order to ensure that the head rotation detection unit 26 adapts to changing hearing situations and that, in particular, the evaluation unit 30 only takes account of the notch directions N of those beamformers 28 that have aligned with a dominant and long-term active source of noise, the beamformers 28 are dynamically (by using software, for example as objects of the same class) generated (activated) during the operation of the hearing aid system 2 and ended (deactivated) when necessary in a preferred embodiment of the hearing aid system 2.

By way of example, the head rotation detection unit 26 generates a new beamformer 28 at regular time intervals (e.g., every 60 seconds) and orders the latter right at the bottom of the cascade of coupled beamformers 28.

Should one of the beamformers 28 be permanently searching during a given time interval (of 40 seconds, for example) and consequently be unable to attain any significant energy minimization (in particular should the variable ER permanently be below the limit for the specified time interval), this beamformer 28 deactivates itself autonomously and is consequently removed from the cascade of coupled beamformers 28.

What the above-described automatic activation and deactivation of the beamformers 28 ensures is that the number of the beamformers 28 (active within the scope of the head rotation detection unit 26) is regularly adapted to the number of dominant sources of noise in the surroundings of the user. However, to avoid a numerical overload of the signal processor 12, the number of simultaneously active beamformers 28 is preferably restricted to a specified maximum number, e.g., five beamformers 28.

In a variant of the hearing aid system 2 not explicitly illustrated, the evaluation unit 30 acts back on the beamformers 28 by virtue of, in the case of an identification of a head rotation, triggering an adaptation of the notch direction N of the or each searching beamformer 28 through the angle of the identified head rotation. Consequently, the beamformers 28 remain aligned with their associated source of noise in the case of a head rotation, even if their source of noise was briefly inactive during the head rotation. Consequently, the beamformer 28 is immediately utilizable again as soon as the source of noise becomes active again, even during and after the head rotation.

Figure 3:
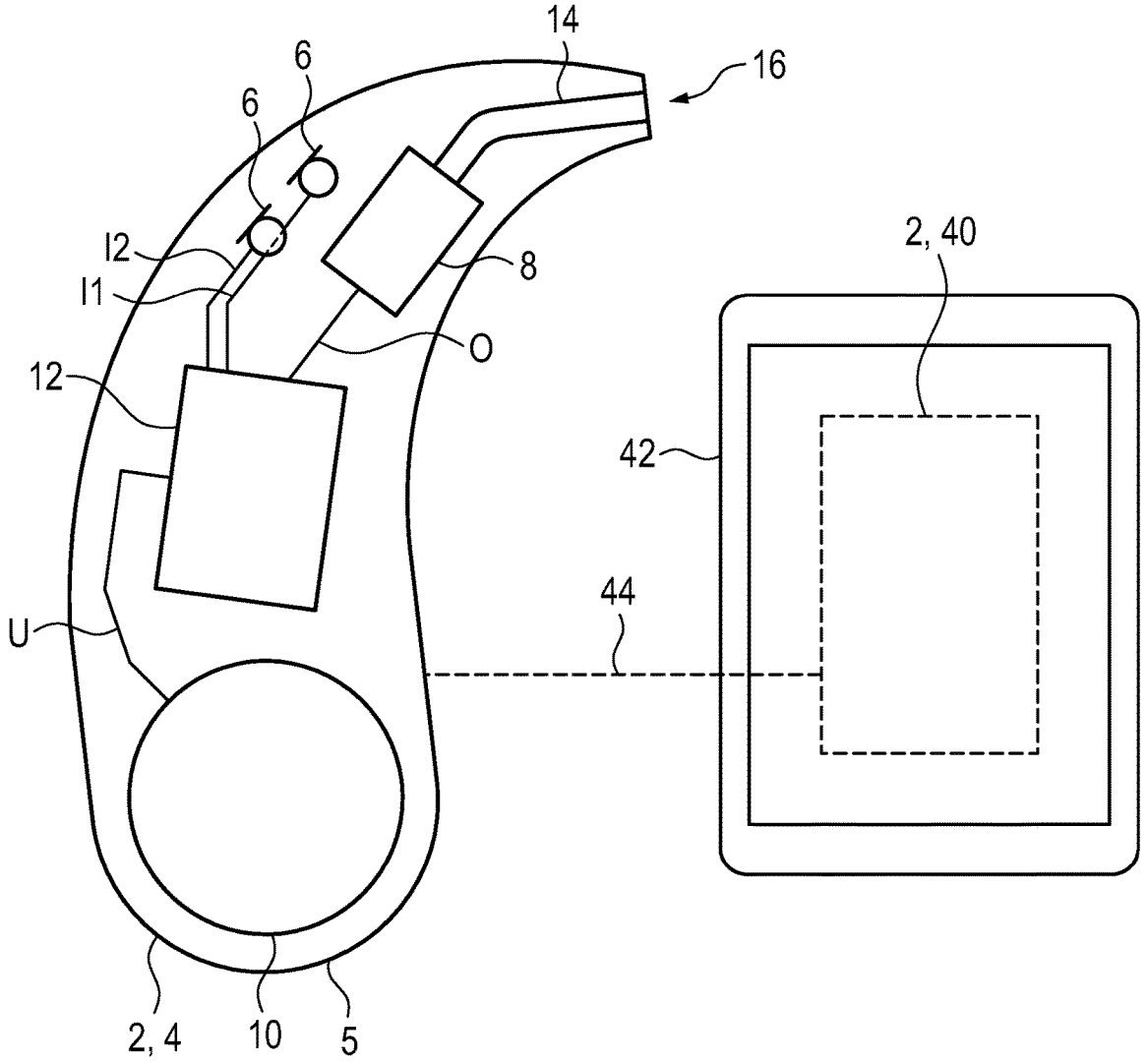
FIG. 3 is an illustration similar to FIG. 1, showing an alternative embodiment of the hearing aid system in which the latter includes a hearing aid instrument in the form of a behind-the-ear hearing aid and a control program implemented on a smartphone ("hearing app").

FIG. 3 shows a further embodiment of the hearing aid system 2, in which the latter includes control software in addition to the hearing aid 4 (or two hearing aids of this type for supplying the two ears of the user). This control software is referred to as a hearing app (or application) 40 below. The hearing app 40 is installed on a smartphone 42 in the example illustrated in FIG. 3. In this case, the smartphone 42 itself is not part of the hearing aid system 2. Rather, the smartphone 42 is only used as a resource for memory and computing power by the hearing app 40.

The hearing aid 4 and the hearing app 40 exchange data through a wireless data transmission link 44 during the operation of the hearing aid system 2. By way of example, the data transmission link 44 is based on the Bluetooth standard. In this case, the hearing app 40 accesses a Bluetooth transceiver of the smartphone 42 in order to receive data from the hearing aid 4 and in order to transmit data to the latter. In turn, the hearing aid 4 includes a Bluetooth transceiver (not explicitly illustrated) in order to transmit data to the hearing app 40 and to receive data from this app.

In the embodiment as per FIG. 3, some of the software components required to carry out the method as per FIG. 2 are not implemented in the signal processor 12 but instead in the hearing app 40. By way of example, the evaluation unit 30 is implemented in the hearing app 40 in the embodiment as per FIG. 3.

The invention becomes particularly clear on the basis of the above-described exemplary embodiments although it is equally not restricted to these exemplary embodiments. Rather, further embodiments of the invention can be derived by a person skilled in the art from the claims and the above description.

The following is a summary list of reference numerals and the corresponding structure used in the above description of the invention:

2 Hearing aid system
4 Hearing aid
5 Housing
6 Microphone
8 Receiver
10 Battery
12 Signal processor
14 Sound channel
16 Tip
18 Signal processing unit
20 Signal analysis unit
22 Pre-processing unit
24 Signal processing process

26 Head rotation detection unit
28 Beamformer
28*a*-28*c* Beamformer
30 Evaluation unit
32 Parameterization unit
40 Hearing app
42 Smartphone
44 Data transmission link
a Weighting factor
D Notification signal
I1, I2 Input audio signal
I1', I2' (Internal) audio signal
N Notch direction
O Output audio signal
P Signal processing parameter
R (Direction-dependently damped) audio signal
U Supply voltage

The invention claimed is:

1. A method for operating a hearing aid system for assisting a user's ability to hear, the method comprising:

providing at least one hearing aid instrument to be worn on a user's head or in or on an ear;

using at least two input transducers of the hearing aid system to record and convert a sound signal from a user's surroundings into input audio signals;

applying a first adaptive beamformer with a variable first notch direction indirectly or directly to the input audio signals for generating a first direction-dependently damped audio signal and setting the first notch direction to minimize an energy content of the first direction-dependently damped audio signal;

applying a second adaptive beamformer with a variable second notch direction indirectly or directly to the input audio signals for generating a second direction-dependently damped audio signal and setting the second notch direction to a value differing from the first notch direction to minimize an energy content of the second direction-dependently damped audio signal; and evaluating the first notch direction and the second notch direction in comparative fashion and capturing a user's head rotation at least one of qualitatively or quantitatively upon determining a correlated change in the first notch direction and the second notch direction within a scope of the comparative evaluation.

2. The method according to claim 1, which further comprises at least one of generating a notification signal indicating the head rotation or capturing a time of the head rotation for the qualitative capture of the head rotation.

3. The method according to claim 1, which further comprises capturing a measured variable characteristic for at least one of a rate of rotation, a rotary angle interval, a duration of the head rotation or an orientation of the head in a surrounding space for the quantitative capture of the head rotation.

4. The method according to claim 1, which further comprises:

applying at least one further adaptive beamformer with a variable further notch direction indirectly or directly to the input audio signals for generating a further direction-dependently damped audio signal and setting the further notch direction to a value differing from the notch directions of other beamformers to minimize an energy content of the further direction-dependently damped audio signal; and evaluating the first notch direction, the second notch direction and the at least one further notch direction in comparative fashion and capturing a user's head rotation at least one of qualitatively or quantitatively upon determining a correlated change in at least two of the notch directions within the scope of the comparative evaluation.

5. The method according to claim 1, which further comprises taking at least one of the notch directions into account with a different weighting in the comparative evaluation, depending on a magnitude of the energy minimization obtained by the variation in the at least one notch direction.

6. The method according to claim 1, which further comprises taking at least one of the notch directions into account with a different weighting in the comparative evaluation, depending on a time stability of the at least one notch direction.

7. The method according to claim 1, which further comprises using a number of signal processing processes to indirectly or directly modify the input audio signals, depending on a number of adjustable signal processing parameters, in a signal processing unit of the at least one hearing aid instrument in order to be output to the user by using an output transducer of the hearing aid instrument and setting at least one signal processing parameter depending on at least one of the qualitative or quantitative capture of the head rotation.

8. The method according to claim 1, which further comprises using at least one adaptive signal processing process to indirectly or directly modify the input audio signals, depending on an adjustable adaptation speed, in a signal processing unit of the at least one hearing aid instrument in order to be output to the user by using an output transducer of the hearing aid instrument and setting the adaptation speed depending on at least one of the qualitative or quantitative capture of the head rotation.

9. A hearing aid system for assisting a user's ability to hear, the hearing aid system comprising:

at least one hearing aid instrument to be worn on a user's head or in or on an ear;

at least two input transducers of the hearing aid system for recording a sound signal from the user's surroundings and for converting the sound signal into input audio signals;

a first adaptive beamformer of the hearing aid system with a variable first notch direction indirectly or directly receiving the input audio signals, said first adaptive beamformer configured to generate a first direction-dependently damped audio signal and to set the first notch direction to minimize an energy content of the first direction-dependently damped audio signal;

a second adaptive beamformer of the hearing aid system with a variable second notch direction indirectly or directly receiving the input audio signals, said second adaptive beamformer configured to generate a second direction-dependently damped audio signal and to set the second notch direction to minimize an energy content of the second direction-dependently damped audio signal; and an evaluation unit of the hearing aid system configured to evaluate the first notch direction and the second notch direction in comparative fashion and to at least one of qualitatively or quantitatively capture a user's head rotation upon said evaluation unit determining a correlated change in the first notch direction and the second notch direction within a scope of the comparative evaluation.

10. The hearing aid system according to claim 9, wherein said evaluation unit is configured to at least one of generate a notification signal indicating the head rotation or capture a time of the head rotation for the qualitative capture of the head rotation.

11. The hearing aid system according to claim 9, wherein said evaluation unit is configured to capture at least one of a variable characteristic for a rate of rotation, a rotary angle interval, a duration of the head rotation or an orientation of the head in a surrounding space for the quantitative capture of the head rotation.

12. The hearing aid system according to claim 9, which further comprises:

at least one further adaptive beamformer of the hearing aid system with a variable further notch direction indirectly or directly receiving the input audio signals, said further adaptive beamformer configured to generate a further direction-dependently damped audio signal and to set the further notch direction to a value differing from the notch directions of other beamformers to minimize an energy content of the further direction-dependently damped audio signal; and said evaluation unit configured to evaluate the first notch direction, the second notch direction and the at least one further notch direction in comparative fashion and to capture a user's head rotation at least one of qualitatively or quantitatively upon determining a correlated change in at least two of the notch directions within a scope of the comparative evaluation.

13. The hearing aid system according to claim 9, wherein said evaluation unit is configured to take into account at least one of the notch directions with a different weighting in the comparative evaluation, depending on a magnitude of the energy minimization obtained by the variation in the at least one notch direction.

14. The hearing aid system according to claim 9, wherein said evaluation unit is configured to take into account at least one of the notch directions with a different weighting in the comparative evaluation, depending on a time stability of the at least one notch direction.

15. The hearing aid system according to claim 9, which further comprises a signal processing unit of said at least one hearing aid instrument configured to modify the input audio signals or audio signals derived from the input audio signals, by using a number of signal processing processes, depending on a number of adjustable signal processing parameters, in order to be output to the user by using an output transducer of the hearing aid instrument and a device of the hearing aid system for setting at least one signal processing parameter depending on at least one of the qualitative or quantitative capture of the head rotation.

16. The hearing aid system according to claim 9, which further comprises a signal processing unit of the at least one hearing aid instrument configured to modify the input audio signals or audio signals derived from the input audio signals, by using at least one adaptive signal processing process, depending on an adjustable adaptation speed, in order to be output to the user by using an output transducer of the hearing aid instrument and a device of the hearing aid system for setting the adaptation speed depending on at least one of the qualitative or quantitative capture of the head rotation.

* * * * *